US009670016B1

(12) United States Patent
Chou et al.

(10) Patent No.: US 9,670,016 B1
(45) Date of Patent: Jun. 6, 2017

(54) TRANSMISSION DEVICE OF AUTOMATIC DOCUMENT FEEDER

(71) Applicant: Foxlink Image Technology Co., Ltd., New Taipei (TW)

(72) Inventors: Hung Ming Chou, New Taipei (TW); Chi Cheng Chuang, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 15/051,108

(22) Filed: Feb. 23, 2016

(51) Int. Cl.

| | |
|---|---|
| ***B65H 5/00*** | (2006.01) |
| ***B65H 3/06*** | (2006.01) |
| ***F16H 1/00*** | (2006.01) |
| ***F16H 37/02*** | (2006.01) |

(52) U.S. Cl.
CPC ..... *B65H 3/0669* (2013.01); *B65H 3/0684* (2013.01); *F16H 1/003* (2013.01); *F16H 37/02* (2013.01); *B65H 2403/20* (2013.01); *B65H 2403/50* (2013.01); *B65H 2403/80* (2013.01)

(58) Field of Classification Search
CPC ..... B65H 3/06; B65H 3/0669; B65H 5/06; B65H 5/062; B65H 29/125; B65H 2403/00; B65H 2403/20; B65H 2403/21; B65H 2403/50; B65H 2403/80; B65H 2404/25; B65H 3/0684; F16H 1/003; F16H 37/02
See application file for complete search history.

(56) References Cited

U.S. PATENT DOCUMENTS

| | | | | |
|---|---|---|---|---|
| 6,307,621 | B1 * | 10/2001 | Endo | B65H 3/0615 346/134 |
| 2003/0146561 | A1 * | 8/2003 | Chen | B65H 5/06 271/10.11 |
| 2004/0124575 | A1 * | 7/2004 | Lee | B65H 3/08 271/10.01 |
| 2009/0289408 | A1 * | 11/2009 | Hamada | B65H 5/062 271/3.14 |
| 2014/0319764 | A1 * | 10/2014 | Saito | F16D 3/12 271/258.01 |
| 2016/0251182 | A1 * | 9/2016 | Kii | B65H 7/00 358/1.12 |

* cited by examiner

*Primary Examiner* — Prasad Gokhale
(74) *Attorney, Agent, or Firm* — WPAT, P.C., Intellectual Property Attorneys; Anthony King

(57) ABSTRACT

A transmission device of automatic document feeder includes a pickup roller assembly, a paper-feed roller assembly, a paper-out roller assembly, a pickup gear assembly for driving the pickup roller assembly, a first transmission gear assembly, a second transmission gear assembly, a drive gear assembly and a motor. The paper-feed roller assembly includes a paper-feed shaft. The paper-out roller assembly includes a paper-out shaft. The first transmission gear assembly includes a first one-way gear and a second one-way gear. The motor bidirectionally drives the drive gear assembly. The motor drives the drive gear assembly to drive the first one-way gear together with the second transmission gear assembly or the second one-way gear together with the second transmission gear assembly to drive the paper-out shaft and the paper-feed shaft to unidirectionally rotate towards the same direction.

8 Claims, 4 Drawing Sheets

TRANSMISSION DEVICE OF AUTOMATIC DOCUMENT FEEDER

BACKGROUND OF THE INVENTION

1. Field of the Invention

The present invention generally relates to a transmission device, and more particularly to a transmission device of automatic document feeder.

2. The Related Art

With the development of softwares and hardwares, a scanner has become one of basic equipments of a computer user. Words and images of documents, magazines, books, pictures and so on, can be scanned into a computer and processed by the scanner. Generally, the scanner includes a motor, a transmission mechanism and a scanning unit. The transmission mechanism includes a gear assembly disposed on the scanning unit, and a transmission belt. When the documents are to be scanned, two scanning ways are capable of being applied. One of the scanning ways is described as follows: the motor drives the transmission mechanism to bring along the scanning unit to scan the documents located above the scanning unit. In order to improve an efficiency of scanning the documents, the scanner further includes an automatic document feeder. The other scanning way is described as follows: the scanning unit is without being moved, the transmission mechanism drives the documents to be scanned by the scanner with the automatic document feeder to achieve an image scanning purpose as well.

Referring to FIG. 1, a conventional automatic document feeder 100' has a passageway for transmitting papers. The passageway includes an input tray 10', a paper-feed channel 11', a scanning channel 12', a paper-out channel 13' and an output tray 14'. In order to make the papers transmitted through the passageway, the conventional automatic document feeder 100' further includes a scanning unit located under the scanning channel 12', and a transmission device disposed along the passageway. The transmission device generally includes a pickup device 15' and a plurality of feeding rollers 16'. The pickup device 15' is disposed to an entrance of the paper-feed channel 11'. The feeding rollers 16' are disposed along the paper-feed channel 11' and the paper-out channel 13'.

When the papers are scanned, the pickup device 15' will press downward on the papers which are placed in the input tray 10' to start feeding a top piece of the papers into the paper-feed channel 11', the feeding rollers 16' rotate towards a single direction to feed the paper into the scanning channel 12', the scanning unit reads images of the paper, and the scanned paper is transmitted into the output tray 14'. When the scanning of the paper is to be cancelled midway by a user, a cancelling button is pressed, the conventional automatic document feeder 100' stops working. Then a cover of the scanner is opened, and the paper is pulled out.

However, the paper is easily damaged in the process of the paper being pulled out, the conventional automatic document feeder 100' mostly needs at least two motors, clutches or magnetic valves and so on to drive the pickup device 15' and the feeding rollers 16' that increases a volume of the conventional automatic document feeder 100' and a manufacturing cost of the conventional automatic document feeder 100'.

In order to solve the above-mentioned problems, an innovative transmission device of automatic document feeder and an innovative automatic document feeder are essential to be provided to decrease a volume of the innovative automatic document feeder and a manufacturing cost of the innovative automatic document feeder.

SUMMARY OF THE INVENTION

An object of the present invention is to provide a transmission device of automatic document feeder. The transmission device of automatic document feeder includes a pickup roller assembly, a paper-feed roller assembly, a paper-out roller assembly, a pickup gear assembly for driving the pickup roller assembly, a first transmission gear assembly, a second transmission gear assembly, a drive gear assembly and a motor. The paper-feed roller assembly includes a paper-feed shaft, and a paper-feed roller mounted around the paper-feed shaft. The paper-out roller assembly includes a paper-out shaft, and a paper-out roller mounted around the paper-out shaft. The first transmission gear assembly includes a first one-way gear and a second one-way gear mounted around the paper-out shaft or the paper-feed shaft. And the first one-way gear and the second one-way gear rotate towards opposite directions. The second transmission gear assembly connects the paper-out shaft and the paper-feed shaft for transmitting transmission torques. The drive gear assembly is for driving the pickup gear assembly, the first transmission gear assembly and the second transmission gear assembly. The motor bidirectionally drives the drive gear assembly. When the motor drives the drive gear assembly to rotate towards different directions, the pickup gear assembly drives the pickup roller assembly to rotate towards different directions. The motor drives the drive gear assembly to drive the first one-way gear together with the second transmission gear assembly or the second one-way gear together with the second transmission gear assembly to drive the paper-out shaft and the paper-feed shaft to unidirectionally rotate towards the same direction.

Another object of the present invention is to provide a transmission device of automatic document feeder. The transmission device of automatic document feeder includes a pickup roller assembly, a paper-feed roller assembly, a paper-out roller assembly, a pickup gear assembly for driving the pickup roller assembly, a first transmission gear assembly, a second transmission gear assembly, a drive gear assembly and a motor. The pickup roller assembly includes a separation shaft. The paper-feed roller assembly includes a paper-feed shaft, and a paper-feed roller mounted around the paper-feed shaft. The paper-out roller assembly includes a paper-out shaft, and a paper-out roller mounted around the paper-out shaft. The pickup gear assembly for driving the pickup roller assembly, includes a first pickup transmission gear, a second pickup transmission gear engaged with the first pickup transmission gear and connected with the pickup roller assembly, and a second transmission belt. The first transmission gear assembly includes a first one-way gear and a second one-way gear mounted around the paper-out shaft or the paper-feed shaft, and the first one-way gear and the second one-way gear rotate towards opposite directions, a first transmission gear engaged with the first one-way gear, a second transmission gear of which two ends are respectively engaged with the first transmission gear and the second one-way gear. The second transmission belt loops around the first pickup transmission gear and the first one-way gear. The second transmission gear assembly includes a third transmission gear mounted to the paper-feed shaft, a fourth transmission gear mounted to the paper-out shaft, and a third transmission belt looping around the third transmission gear and the fourth transmission gear. The drive gear assembly includes a drive gear, and a first transmission belt looping around the drive gear and the first one-way gear. The motor is connected with the drive gear. When the motor drives the drive gear assembly to rotate towards different directions, the pickup gear assembly drives the pickup roller assembly to rotate towards different directions. The motor drives the drive gear assembly to drive the first one-way gear together with the second transmission gear assembly or the second one-way gear together with the second transmission gear assembly to drive the paper-out shaft and the paper-feed shaft to unidirectionally rotate towards the same direction.

As described above, the motor is capable of simultaneously driving the pickup roller assembly, the paper-feed roller assembly and the paper-out roller assembly, regardless of the motor rotating in a forward direction to scan the paper or the motor rotating in a reverse direction to cancel the scanning, the motor is capable of driving the paper-feed roller and the paper-out roller to unidirectionally rotate towards the same direction to transmit the paper out of the paper-out channel, so that when the scanning is cancelled, a cover of the automatic document feeder has no need of being opened to pull the paper out.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
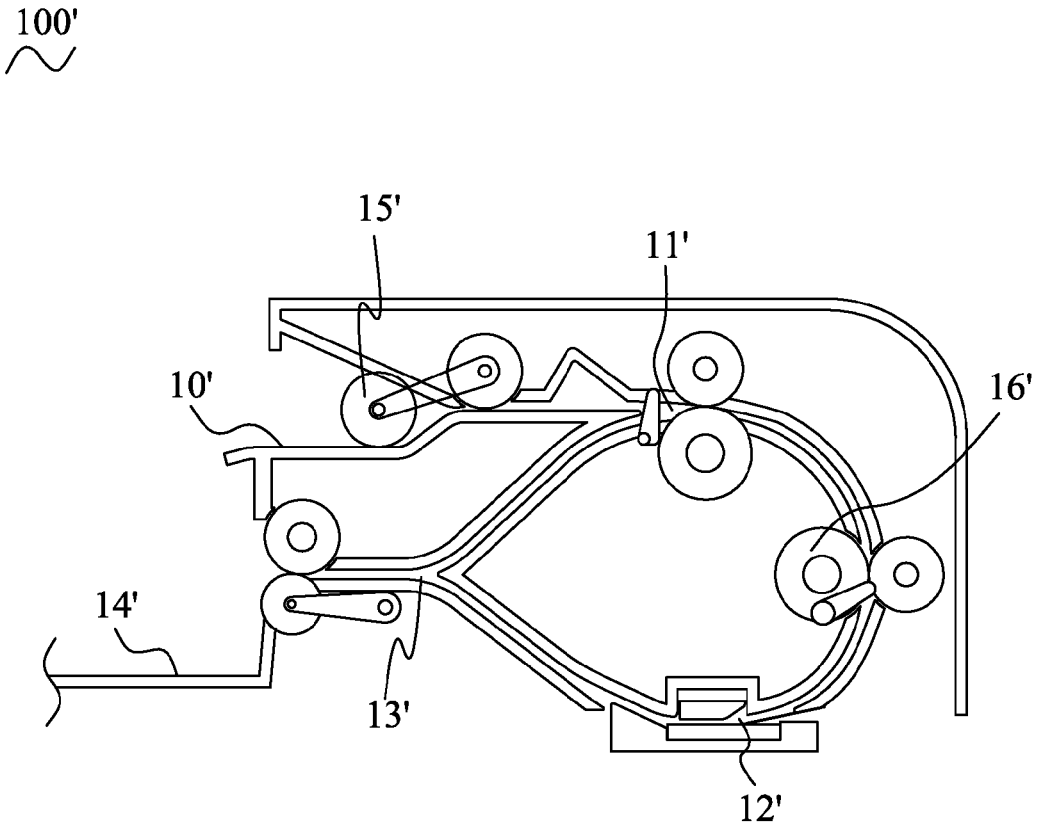
FIG. 1 (Prior Art)
FIG. 1 is a schematic diagram of an automatic document feeder in prior art.
Figure 2:
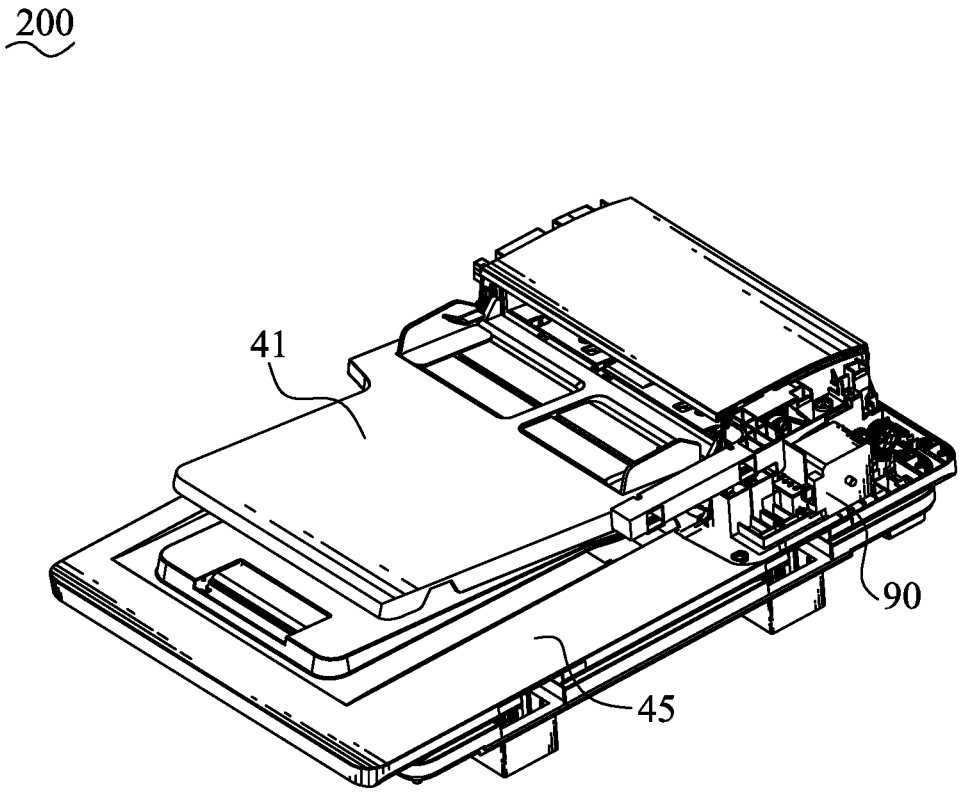
FIG. 2 is a perspective view of an automatic document feeder in accordance with the present invention.
Figure 3:
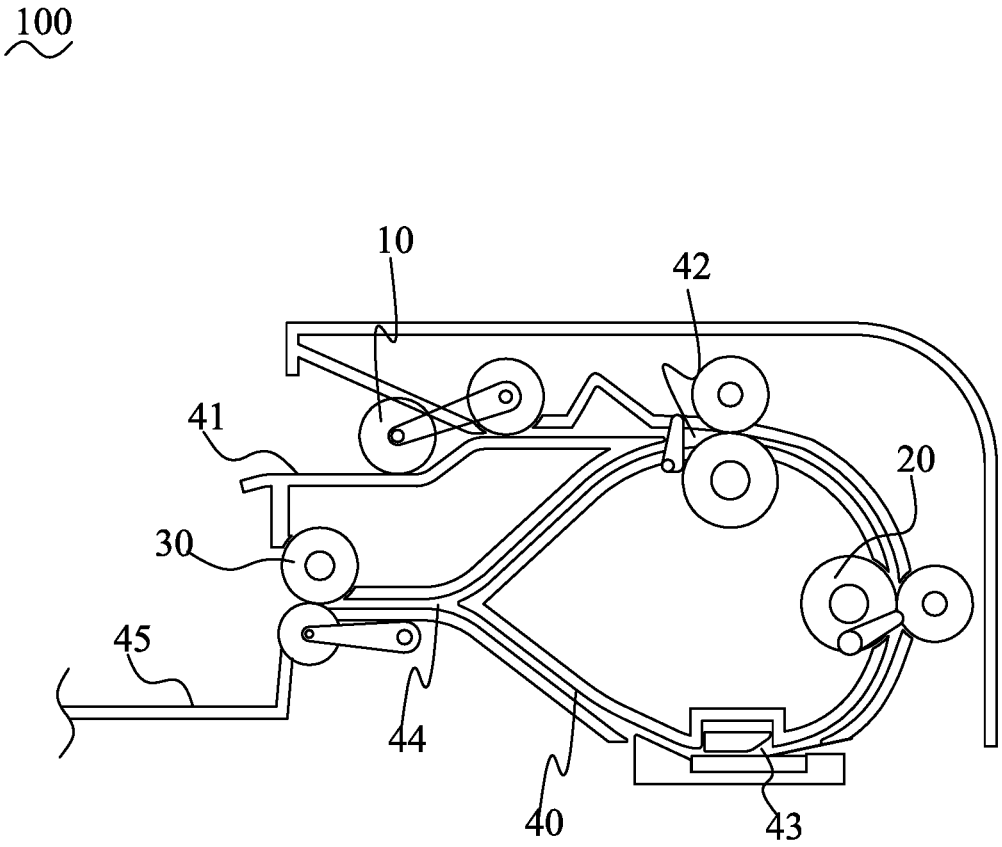
FIG. 3 is a schematic diagram of the automatic document feeder of FIG. 2.

With reference to FIG. 2 and FIG. 3, a transmission device of automatic document feeder 100 in accordance with an embodiment of the present invention is shown. The transmission device of automatic document feeder 100 is adapted for being assembled in an automatic document feeder 200. The automatic document feeder 200 includes a passageway 40 for feeding papers (not shown). The passageway 40 includes an input tray 41, a paper-feed channel 42, a scanning channel 43, a paper-out channel 44 and an output tray 45 which are disposed in sequence from upstream to downstream. The transmission device of automatic document feeder 100 includes a pickup roller assembly 10, a paper-feed roller assembly 20, a paper-out roller assembly 30, and a motor 90 for driving the pickup roller assembly 10, the paper-feed roller assembly 20 and the paper-out roller assembly 30. In this embodiment, a clockwise direction is a forward direction. An anticlockwise direction is a reverse direction.

Figure 4:
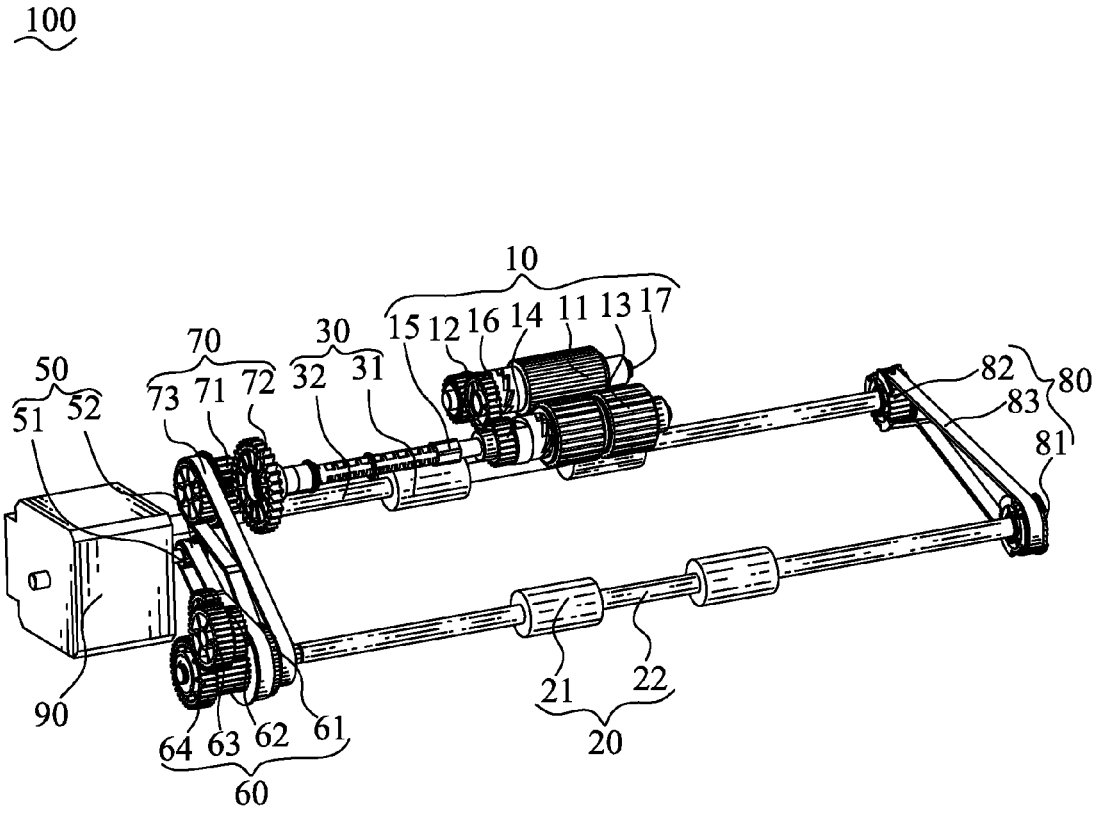
FIG. 4 is a perspective view of a transmission device of automatic document feeder of FIG. 2.

Referring to FIG. 3 and FIG. 4, the pickup roller assembly 10 is disposed at an entrance of the passageway 40, and located between the input tray 41 and the paper-feed channel 42. The pickup roller assembly 10 includes a paper-in roller 11, a paper-in gear 12, a paper-in shaft 17, a separation roller 13, a separation gear 14, a separation shaft 15 and a connecting gear 16. The paper-in gear 12 is mounted to one end of the paper-in shaft 17. The paper-in roller 11 is mounted around the paper-in shaft 17. The separation gear 14 is mounted to one end of the separation shaft 15. The separation roller 13 is mounted around the separation shaft 15. The connecting gear 16 is disposed between and engaged with the paper-in gear 12 and the separation gear 14 for making the paper-in roller 11 and the separation roller 13 rotate towards the same direction. The separation roller 13 is for separating the papers picked up by the paper-in roller 11 so as to ensure the papers to be transmitted to the paper-feed channel 42 piece by piece and further bringing along each piece of the paper to be transmitted downstream. The paper-feed roller assembly 20 includes a paper-feed shaft 22, and a paper-feed roller 21 mounted around the paper-feed shaft 22.

The paper-out roller assembly 30 is disposed at an exit of the passageway 40 and located between the output tray 45 and the paper-out channel 44. The paper-out roller assembly 30 includes a paper-out shaft 32, and a paper-out roller 31 mounted around the paper-out shaft 32.

The transmission device of automatic document feeder 100 further includes a drive gear assembly 50, a pickup gear assembly 70, a first transmission gear assembly 60 and a second transmission gear assembly 80. The drive gear assembly 50 is for driving the pickup gear assembly 70, the first transmission gear assembly 60 and the second transmission gear assembly 80.

The drive gear assembly 50 is driven by the motor 90 for driving the pickup roller assembly 10. Specifically, the drive gear assembly 50 includes a drive gear 51 connected with the motor 90, and a first transmission belt 52.

The first transmission gear assembly 60 includes a first one-way gear 61, a first transmission gear 62, a second transmission gear 63 and a second one-way gear 64. The first one-way gear 61 and the second one-way gear 64 are mounted around the paper-out shaft 32 or the paper-feed shaft 22, and the first one-way gear 61 and the second one-way gear 64 rotate towards opposite directions. The motor 90 drives the drive gear assembly 50 to drive the first one-way gear 61 together with the second transmission gear assembly 80 or the second one-way gear 64 together with the second transmission gear assembly 80 to drive the paper-out shaft 32 and the paper-feed shaft 22 to unidirectionally rotate towards the same direction.

The first transmission gear 62 is engaged with the first one-way gear 61. Two ends of the second transmission gear 63 are respectively engaged with the first transmission gear 62 and the second one-way gear 64. The first transmission belt 52 loops around the drive gear 51 and the first one-way gear 61. In this embodiment, the first transmission gear assembly 60 is mounted to one end of the paper-feed shaft 22. In another embodiment, the first transmission gear assembly 60 is mounted to one end of the paper-out shaft 32.

The pickup gear assembly 70 is for driving the pickup roller assembly 10. When the motor 90 drives the drive gear assembly 50 to rotate towards different directions, the pickup gear assembly 70 drives the pickup roller assembly 10 to rotate towards different directions. Specifically, the pickup gear assembly 70 includes a first pickup transmission gear 71, a second pickup transmission gear 72 engaged with the first pickup transmission gear 71 and connected with the pickup roller assembly 10, and a second transmission belt 73. The second transmission belt 73 loops around the first pickup transmission gear 71 and the first one-way gear 61. The second pickup transmission gear 72 is mounted to the other end of the separation shaft 15.

The second transmission gear assembly 80 connects the paper-out shaft 32 and the paper-feed shaft 22 for transmitting transmission torques. The second transmission gear assembly 80 includes a third transmission gear 81 mounted to the other end of the paper-feed shaft 22, a fourth transmission gear 82 mounted to the paper-out shaft 32, and a third transmission belt 83 looping around the third transmission gear 81 and the fourth transmission gear 82.

Referring to FIG. 2, FIG. 3 and FIG. 4, the motor 90 bidirectionally drives the drive gear assembly 50. The drive gear assembly 50 rotates towards different directions, the pickup gear assembly 70 drives the pickup roller assembly 10 to rotate towards different directions. The motor 90 is capable of simultaneously driving the pickup roller assembly 10, the paper-feed roller assembly 20 and the paper-out roller assembly 30. Regardless of the motor 90 rotating in the forward direction to scan the papers or the motor 90 rotating in the reverse direction to cancel the scanning, the motor 90 is capable of driving the paper-feed roller 21 and the paper-out roller 31 to rotate towards the same direction, in the present invention, the motor 90 is capable of driving the paper-feed roller 21 and the paper-out roller 31 to rotate clockwise to transmit the papers out of the paper-out channel 44, so that when the scanning is cancelled, a cover of the automatic document feeder 200 has no need of being opened to pull the paper out.

Referring to FIG. 2 to FIG. 4, an action process of the transmission device of the automatic document feeder 100 and the automatic document feeder 200 proceeding one-sided scanning is described as follows.

When the automatic document feeder 200 starts scanning, the papers are located in the input tray 41. The motor 90 rotates clockwise to drive the drive gear 51 to rotate clockwise, the drive gear 51 drives the first one-way gear 61 to rotate clockwise by the first transmission belt 52, the first one-way gear 61 drives the first pickup transmission gear 71 to rotate clockwise by the second transmission belt 73. The first pickup transmission gear 71 is engaged with the second pickup transmission gear 72, the first pickup transmission gear 71 drives the second pickup transmission gear 72 to rotate anticlockwise, the second pickup transmission gear 72 drives the pickup device 10 to move downward to press on the papers loaded in the input tray 41, and the second pickup transmission gear 72 drives the paper-in roller 11 and the separation roller 13 to rotate anticlockwise, then transmits a top piece of the papers to the paper-feed channel 42. Simultaneously, the first one-way gear 61 drives the paper-feed roller 21 to rotate clockwise so as to further transmit the paper to the scanning channel 43, the paper is scanned, and the scanned paper is transmitted to the paper-out channel 44. The first transmission gear 62 is engaged with the first one-way gear 61 and the second transmission gear 63, the first one-way gear 61 drives the second transmission gear 63 to rotate clockwise, the second transmission gear 63 drives the second one-way gear 64 to rotate anticlockwise, the second one-way gear 64 has no way of driving the paper-feed shaft 22 to rotate. The first one-way gear 61 drives the paper-feed shaft 22 to rotate clockwise so as to drive the third transmission gear 81 to rotate clockwise, the third transmission gear 81 drives the fourth transmission gear 82 to rotate clockwise by the third transmission belt 83, the fourth transmission gear 82 drives the paper-out shaft 32 together with the paper-out roller 31 to rotate clockwise, the paper is further transmitted out of the paper-out channel 44 by the paper-out roller 31, the paper is completed being scanned.

When a user wishes to cancel the scanning, a cancelling button is pressed downward. The motor 90 rotates anticlockwise to drive the drive gear 51 to rotate anticlockwise, the drive gear 51 drives the first one-way gear 61 to rotate anticlockwise by the first transmission belt 52, the first one-way gear 61 drives the first pickup transmission gear 71 to rotate anticlockwise by the second transmission belt 73. The first pickup transmission gear 71 is engaged with the second pickup transmission gear 72, the first pickup transmission gear 71 drives the second pickup transmission gear 72 to rotate clockwise, the second pickup transmission gear 72 drives the pickup device 10 to be raised up to depart from the papers loaded in the input tray 41. At the same time, the first one-way gear 61 is unable to drive the paper-feed shaft 22 to rotate, the first one-way gear 61 drives the second one-way gear 64 to rotate clockwise by the first transmission gear 62 and the second transmission gear 63, the second one-way gear 64 drives the paper-feed shaft 22 together with the paper-feed roller 21 to rotate clockwise, the paper-feed roller 21 rotates clockwise to transmit the papers to the scanning channel 43. The second one-way gear 64 drives the paper-feed shaft 22 to rotate clockwise so as to drive the third transmission gear 81 to rotate clockwise, the third transmission belt 83 drives the fourth transmission gear 82 to rotate clockwise by the third transmission belt 83, the fourth transmission gear 82 drives the paper-out shaft 32 together with the paper-out roller 31 to rotate clockwise, the papers are further transmitted out of the paper-out channel 44 by the paper-out roller 31.

As described above, the motor 90 is capable of simultaneously driving the pickup roller assembly 10, the paper-feed roller assembly 20 and the paper-out roller assembly 30, regardless of the motor 90 rotating in the forward direction to scan the paper or the motor 90 rotating in the reverse direction to cancel the scanning, the motor 90 is capable of driving the paper-feed roller 21 and the paper-out roller 31 to unidirectionally rotate towards the same direction to transmit the paper out of the paper-out channel 44, so that when the scanning is cancelled, the cover of the automatic document feeder 200 has no need of being opened to pull the paper out.

What is claimed is:

1. A transmission device of automatic document feeder, comprising:

a pickup roller assembly;

a paper-feed roller assembly including a paper-feed shaft, and a paper-feed roller mounted around the paper-feed shaft;

a paper-out roller assembly including a paper-out shaft, and a paper-out roller mounted around the paper-out shaft;

a pickup gear assembly for driving the pickup roller assembly;

a first transmission gear assembly including a first one-way gear and a second one-way gear mounted around the paper-out shaft or the paper-feed shaft, and the first one-way gear and the second one-way gear rotating towards opposite directions;

a second transmission gear assembly connecting the paper-out shaft and the paper-feed shaft for transmitting transmission torques;

a drive gear assembly for driving the pickup gear assembly, the first transmission gear assembly and the second transmission gear assembly; and a motor bidirectionally driving the drive gear assembly, when the motor drives the drive gear assembly to rotate towards different directions, the pickup gear assembly driving the pickup roller assembly to rotate towards different directions, the motor driving the drive gear assembly to drive the first one-way gear together with the second transmission gear assembly or the second one-way gear together with the second transmission gear assembly to drive the paper-out shaft and the paper-feed shaft to unidirectionally rotate towards the same direction;

wherein the first transmission gear assembly further includes a first transmission gear and a second transmission gear, the first transmission gear is engaged with the first one-way gear, two ends of the second transmission gear are respectively engaged with the first transmission gear and the second one-way gear.

2. The transmission device of automatic document feeder as claimed in claim 1, wherein the drive gear assembly includes a drive gear connected with the motor, and a first transmission belt, the first transmission belt loops around the drive gear and the first one-way gear.

3. The transmission device of automatic document feeder as claimed in claim 2, wherein the pickup gear assembly includes a first pickup transmission gear, a second pickup transmission gear engaged with the first pickup transmission gear and connected with the pickup roller assembly, and a second transmission belt, the second transmission belt loops around the first pickup transmission gear and the first one-way gear.

4. The transmission device of automatic document feeder as claimed in claim 3, wherein the pickup roller assembly includes a paper-in roller, a paper-in gear, a paper-in shaft, a separation roller, a separation gear, a separation shaft and a connecting gear, the paper-in gear is mounted to one end of the paper-in shaft, the paper-in roller is mounted around the paper-in shaft, the separation gear is mounted to one end of the separation shaft, the separation roller is mounted around the separation shaft, the connecting gear is disposed between and engaged with the paper-in gear and the separation gear, the second pickup transmission gear is mounted to the other end of the separation shaft.

5. The transmission device of automatic document feeder as claimed in claim 1, wherein the second transmission gear assembly includes a third transmission gear mounted to the paper-feed shaft, a fourth transmission gear mounted to the paper-out shaft, and a third transmission belt looping around the third transmission gear and the fourth transmission gear.

6. The transmission device of automatic document feeder as claimed in claim 1, wherein the first transmission gear assembly is mounted to the paper-feed shaft.

7. A transmission device of automatic document feeder, comprising:

a pickup roller assembly including a separation shaft;

a paper-feed roller assembly including a paper-feed shaft, and a paper-feed roller mounted around the paper-feed shaft;

a paper-out roller assembly including a paper-out shaft, and a paper-out roller mounted around the paper-out shaft;

a pickup gear assembly for driving the pickup roller assembly, the pickup gear assembly including a first pickup transmission gear, a second pickup transmission gear engaged with the first pickup transmission gear and connected with the pickup roller assembly, and a second transmission belt;

a first transmission gear assembly including a first one-way gear and a second one-way gear mounted around the paper-out shaft or the paper-feed shaft, and the first one-way gear and the second one-way gear rotating towards opposite directions, a first transmission gear engaged with the first one-way gear, a second transmission gear of which two ends are respectively engaged with the first transmission gear and the second one-way gear, the second transmission belt looping around the first pickup transmission gear and the first one-way gear;

a second transmission gear assembly including a third transmission gear mounted to the paper-feed shaft, a fourth transmission gear mounted to the paper-out shaft, and a third transmission belt looping around the third transmission gear and the fourth transmission gear;

a drive gear assembly including a drive gear, and a first transmission belt looping around the drive gear and the first one-way gear; and a motor connected with the drive gear, when the motor drives the drive gear assembly to rotate towards different directions, the pickup gear assembly driving the pickup roller assembly to rotate towards different directions, the motor driving the drive gear assembly to drive the first one-way gear together with the second transmission gear assembly or the second one-way gear together with the second transmission gear assembly to drive the paper-out shaft and the paper-feed shaft to unidirectionally rotate towards the same direction.

8. The transmission device of automatic document feeder as claimed in claim 7, wherein the pickup roller assembly includes a paper-in roller, a paper-in gear, a paper-in shaft, a separation roller, a separation gear, a separation shaft and a connecting gear, the paper-in gear is mounted to one end of the paper-in shaft, the paper-in roller is mounted around the paper-in shaft, the separation gear is mounted to one end of the separation shaft, the separation roller is mounted around the separation shaft, the connecting gear is disposed between and engaged with the paper-in gear and the separation gear, the second pickup transmission gear is mounted to the other end of the separation shaft.

* * * * *